US012392068B2

(12) United States Patent
Lee et al.

(10) Patent No.: US 12,392,068 B2
(45) Date of Patent: Aug. 19, 2025

(54) CLOTHING TREATMENT APPARATUS

(71) Applicant: LG Electronics Inc., Seoul (KR)

(72) Inventors: Dongsoo Lee, Seoul (KR); Taewoong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 260 days.

(21) Appl. No.: 17/910,702

(22) PCT Filed: Feb. 22, 2021

(86) PCT No.: PCT/KR2021/002190
§ 371 (c)(1),
(2) Date: Sep. 9, 2022

(87) PCT Pub. No.: WO2021/182768
PCT Pub. Date: Sep. 16, 2021

(65) Prior Publication Data

US 2023/0137038 A1 May 4, 2023

(30) Foreign Application Priority Data

Mar. 9, 2020 (KR) ..... 10-2020-0029128

(51) Int. Cl.
*D06F 29/00* (2006.01)
*D06F 25/00* (2006.01)
(Continued)

(52) U.S. Cl.
CPC ..... *D06F 29/005* (2013.01); *D06F 25/00* (2013.01); *D06F 37/26* (2013.01); *D06F 39/04* (2013.01);
(Continued)

(58) Field of Classification Search
CPC ..... D06F 29/005
See application file for complete search history.

(56) References Cited

U.S. PATENT DOCUMENTS

2014/0238087 A1 8/2014 Bae et al.
2019/0194860 A1* 6/2019 Li ..... D06F 31/00
2021/0148029 A1* 5/2021 Lv ..... D06F 29/005

FOREIGN PATENT DOCUMENTS

CN 104919108 A 9/2015
CN 208562910 3/2019
(Continued)

OTHER PUBLICATIONS

International Search Report and Written Opinion in International Appln. No. PCT/KR2021/002190, dated Jun. 15, 2021, 15 pages (with English translation).
(Continued)

*Primary Examiner* — Spencer E. Bell
(74) *Attorney, Agent, or Firm* — Fish & Richardson P.C.

(57) ABSTRACT

A clothing treatment apparatus includes a first cabinet forming the outer appearance, a first drum of a cylindrical shape having open front and rear surfaces, a second cabinet located under the first cabinet, a tub located in the second cabinet; a second drum located in the tub to be rotatable and accommodating clothing, a first air suction duct for sucking the air in the first drum, a second air suction duct for sucking the air in the tub, a connection duct connected to the first air suction duct and the second air suction duct and including a heat exchanger for exchanging heat with the sucked air, a first exhaust duct for discharging the air, which has exchanged heat via the heat exchanger, to the first drum, and a second exhaust duct for discharging the air, which has exchanged heat via the heat exchanger, to the tub.

19 Claims, 6 Drawing Sheets

(51) Int. Cl.

| | |
|---|---|
| ***D06F 37/26*** | (2006.01) |
| ***D06F 39/04*** | (2006.01) |
| ***D06F 58/10*** | (2006.01) |
| ***D06F 58/20*** | (2006.01) |
| ***D06F 58/22*** | (2006.01) |

(52) U.S. Cl.
CPC ..... *D06F 58/10* (2013.01); *D06F 58/206* (2013.01); *D06F 58/22* (2013.01)

(56) References Cited

FOREIGN PATENT DOCUMENTS

| | | | |
|---|---|---|---|
| CN | 109554880 | | 4/2019 |
| GB | 191206325 | A | 3/1913 |
| JP | 2008-215180 | A | 9/2008 |
| KR | 20060035385 | | 4/2006 |
| KR | 20060078876 | | 7/2006 |
| KR | 100652459 | | 12/2006 |
| KR | 100662364 | | 1/2007 |
| KR | 20070073144 | | 7/2007 |
| KR | 10-2015-0072169 | A | 6/2015 |
| WO | WO 2018/219133 | | 12/2018 |

OTHER PUBLICATIONS

Extended European Search Report in European Appln. No. 21767164.3, mailed on Apr. 13, 2024, 10 pages.
Office Action in Korean Appln No. 10-2020-0029128, mailed on Jul. 9, 2024, 16 pages (with English Translation).
Office Action in Chinese Appln. No. 202180019631.6, mailed on Mar. 19, 2025, 14 pages (with English translation).

* cited by examiner (a)

(b)

(a)

(b)

CLOTHING TREATMENT APPARATUS

CROSS-REFERENCE TO RELATED APPLICATIONS

This application is a National Stage application under 35 U.S.C. § 371 of International Application No. PCT/KR2021/002190, filed on Feb. 22, 2021, which claims the benefit of Korean Application No. 10-2020-0029128, filed on Mar. 9, 2020. The disclosures of the prior applications are incorporated by reference in their entirety.

TECHNICAL FIELD

The present disclosure relates to a laundry treating apparatus, and more particularly to an integrated laundry treating apparatus in which a washing machine that simultaneously implements a washing function and a drying function and a dryer that performs a drying function are stacked.

BACKGROUND ART

In general, a laundry treating apparatus is an apparatus for processing various tasks related to laundry, and is a concept including a washing machine for washing laundry, a dryer for drying wet laundry, and a refresher for removing odors or wrinkles from laundry.

A conventional washing machine includes a cabinet defining an outer appearance, a tub provided inside the cabinet to store water, a drum rotatably provided inside the tub to store laundry, and a driver for rotating the drum.

In particular, washing machines are classified into top-loading and front-loading washing machines according to a posture of the drum. In the case of the front-loading washing machine, unlike the top-loading washing machine, the drum is laid down, and accordingly, laundry is put into the drum through a front side of the washing machine. Such a front-loading washing machine has a smaller size and has a larger washing capacity than a top-loading washing machine, has high washing performance, and does not cause tangling of laundry, and thus is widely used.

In addition to these washing machines, front-loading dryers have been developed and widely used. A washing machine and a dryer are mostly used together at home or a laundry. In particular, a plurality of washing machines and dryers are used together in a laundry, and washing machines or dryers may be used in combination in pairs. In this case, in order to reduce an installation area, a dryer may be stacked and used above the washing machine. In addition, an all-in-one washing machine equipped with a dryer on the top and a washing machine on the bottom is used in one cabinet.

However, there is a problem in that the height to a laundry inlet of the dryer is too large even in the case of a simply stacked laundry treating apparatus or an integrated washing machine. That is, for a short user, it may be difficult to load or take out laundry from the dryer. In addition, although the washing machine and the dryer perform the same drying function, the drying capacity is different, and thus there is a problem in that parts need to be used separately to provide respective drying functions.

Chinese Laid-Open Patent Publication No. 104928883A discloses a stack-type integrated washing machine to implement drying functions in a washing machine and a dryer, respectively. However, due to different drying capacities of the washing machine and dryer, two condensers are used. In the end, there is a problem that an internal space is not capable of being used efficiently by using separate parts.

DISCLOSURE

Technical Problem

An object of the present disclosure is to simultaneously use a dryer and a washing machine by sharing a connection duct (or a drying module) included in a heat exchanger required for drying functions of a dryer and a washing machine.

An object of the present disclosure is to reduce production cost using a common connection duct.

An object of the present disclosure is to independently or selectively perform a drying function using a common connection duct.

An object of the present disclosure is to conveniently allow a user to easily access an entrance of a dryer by reducing the overall height using a common connection duct.

Technical Solution

To overcome the aforementioned object, an embodiment of the present disclosure is to provide a laundry treating apparatus using one common drying module for an independent or selective drying function in an upper dryer and a lower washing machine.

To this end, according to an embodiment of the present disclosure, a laundry treating apparatus includes a first cabinet defining an outer appearance, a first drum with a cylindrical shape having open front and rear surfaces, a second cabinet disposed below the first cabinet, a tub disposed inside the second cabinet, a second drum rotatably provided inside the tub to accommodate laundry, a first intake duct for sucking air of the first drum, a second intake duct for sucking air of the tub, a connection duct including a heat exchanger connected to the first intake duct and the second intake duct to exchange heat with the sucked air, a first exhaust duct for discharging the air heat-exchanged through the heat exchanger to the first drum, and a second exhaust duct for discharging the air heat-exchanged through the heat exchanger to the tub.

The first cabinet and the second cabinet may be integrally formed.

The laundry treating apparatus may further include a first opening/closing unit for opening and closing the first intake duct, a second opening/closing unit for opening and closing the second intake duct, and a third opening/closing unit for branching the first exhaust duct and the second exhaust duct, wherein, by independently opening and closing the first opening/closing unit, the second opening/closing unit, and the third opening/closing unit, the first intake duct, the connection duct, and the first exhaust duct may form a first circulation path to circulate air of the first drum or the second intake duct, the connection duct, and the second exhaust duct may form a second circulation path to circulate air of the tub.

The first opening/closing unit may be disposed between the first intake duct and the connection duct, and the second opening/closing unit may be disposed between the second intake duct and the connection duct.

The laundry treating apparatus may further include a first purifier disposed in the connection duct to filter a foreign substance before air sucked from the first intake duct and the second intake duct is heat-exchanged, and the first purifier may be detachable from the connection duct through a filter insertion hole provided at a bottom of the first cabinet or a top front surface of the second cabinet.

The first opening/closing unit may be disposed between the first intake duct and an upper part of the first purifier, and the second opening/closing unit may be disposed between the second intake duct and first purifier.

The first opening/closing unit may include a first blocker for opening and closing the first intake duct; and a first opening/closing driver connected to the first blocker and opening and closing the first intake duct by rotating the first blocker, where the second opening/closing unit may include a second blocker for opening and closing the second intake duct, and a second opening/closing driver for opening and closing the second intake duct by rotating the second blocker.

The first blocker may include a first main body formed in a left-to-right side longer than a front-to-rear side with respect to a front surface of the first cabinet and having a curved surface on the front-to-rear side, and a first sub-body with a circular shape coupled to each of both ends in left and right directions of the first main body.

The first opening/closing driver may have a rotation shaft connected to the first sub-body in a longitudinal direction of the first main body.

A thickness of a cross-section of the first main body may increase toward a center.

The first blocker may further include a plurality of first reinforcing ribs protruding from a convex curved surface among curved surfaces of the first main body, and a size of the plurality of first reinforcing ribs may be equal to or smaller than a size of a portion of the first sub-body, positioned toward a direction of the convex curved surface.

The second blocker may include a second main body formed in a left-to-right side longer than a front-to-rear side with respect to a front surface of the first cabinet and having a curved surface on the front-to-rear side, and a second sub-body with a circular shape coupled to each of both ends in left and right directions of the second main body, wherein a thickness of a cross-section of the second main body may increase toward a center.

The second opening/closing driver may have a rotation shaft connected to the second sub-body in a longitudinal direction of the second main body.

The second blocker may further include a plurality of second reinforcing ribs protruding from a convex curved surface among curved surfaces of the first main body, and a size of the plurality of second reinforcing ribs may be equal to or smaller than a size of a portion of the second sub-body, positioned toward a direction of the convex curved surface.

A length in a left and right direction of the first blocker may be longer than a length in a left and right direction of the second blocker.

The first exhaust duct may further include a communication hole for connection with the second exhaust duct, and the connection duct may be connected to the first exhaust duct, and the first exhaust duct may be connected to the second exhaust duct through the communication hole.

The third opening/closing unit may include a third blocker for opening and closing the first exhaust duct and the second exhaust duct, and a third opening/closing driver for rotating the third blocker for opening and closing the first exhaust duct and the second exhaust duct.

The first exhaust duct may further include a guide disposed at a position at which the third blocker rotates inside to close the first exhaust duct and stopping rotation of the third blocker.

The first exhaust duct may further include a blower fan for discharging heat-exchanged air to the first exhaust duct or the second exhaust duct, and the communication hole may be disposed above the blower fan.

The third opening/closing unit may include a third blocker for opening and closing the first exhaust duct or the second exhaust duct, and a third opening/closing driver for rotating the third blocker to be positioned at a first position at which the third blocker opens and closes the second exhaust duct, a second position at which the third blocker opens and closes the first exhaust duct, and a third position at which the third blocker is opened by a predetermined angle to open the first exhaust duct and the second exhaust duct, and the first circulation path or the second circulation path may be selectively formed or both the first circulation path and the second circulation path are formed.

Advantageous Effects

According to the present disclosure, drying functions of a dryer and a washing machine may be simultaneously used by sharing a connection duct required in the drying functions of the dryer and the washing machine.

According to the present disclosure, production cost may be reduced using a common connection duct.

According to the present disclosure, drying functions may be independently or selectively performed using a common connection duct.

According to the present disclosure, the overall height may be lowered using a common connection duct to provide user convenience.

DESCRIPTION OF DRAWINGS

FIG. 4(*b*) shows an example in which a first intake duct and a second intake duct are connected to a filter part provided in a connection duct.

FIG. 5(*b*) shows an example of a third opening/closing driver for opening and closing a third blocker disposed between a first exhaust duct and a second exhaust duct.

FIGS. 6(*c*) and 6(*d*) show an example in which a first intake duct is closed through a first opening/closing unit, a second intake duct is opened through a second opening/closing unit, and a first exhaust duct is closed through a third blocker when air of a tub is circulated.

BEST MODE

Hereinafter, an exemplary embodiment of the present disclosure will be described in detail with reference to the accompanying drawings. The configuration or control method of a device to be described below is only for explaining an embodiment of the present disclosure, not for limiting the scope of the present disclosure, and the same reference numbers used throughout the specification refer to the same components.

Figure 1:
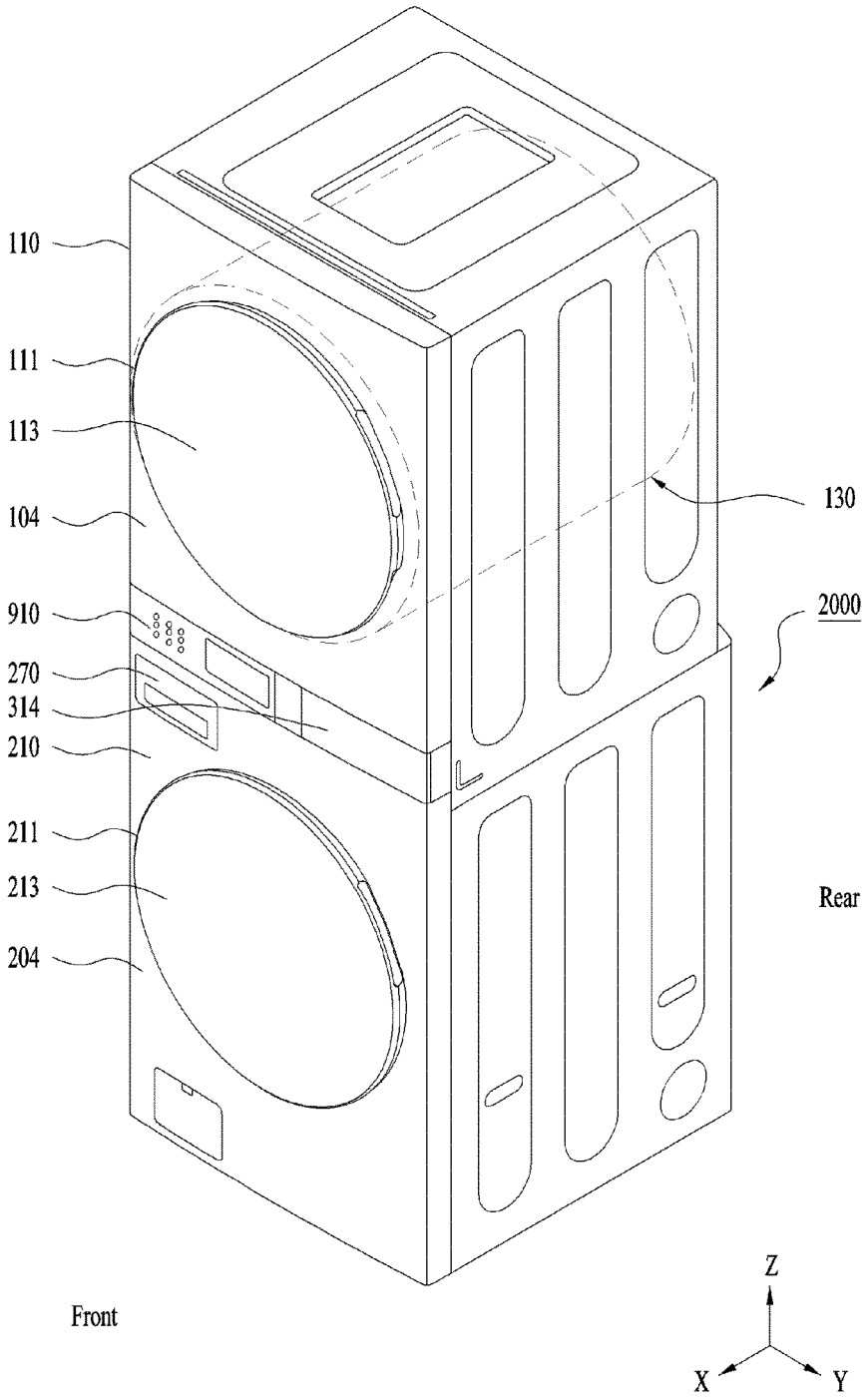
FIG. 1 is a diagram showing an example of a laundry treating apparatus.

Unlike that shown in FIG. 1, a first cabinet 110 and a second cabinet 210 may be integrally formed. That is, a first lower panel 106 of the first cabinet 110 and a second upper panel 208 of the second cabinet are not stacked to face each other, but without the first lower panel 106 and the second upper panel 208, the first cabinet 110 and the second cabinet 210 may be integrally formed, and then may be partitioned with a partition base (not shown) between a first drum 130 and a tub 220. In addition, the partition base (not shown) may be disposed under the first drum 130 to support various components. That is, the partition base may be the first lower panel 106 and may simultaneously function as a base 180 (FIG. 4) to which various components are coupled and supported.

FIG. 1 shows that a control panel 910 is disposed between a first door 113 and a second door 213. Alternatively, however, the control panel 910 may include each of front panels 104 and 204 of the first cabinet 110 and the second cabinet 210. A filter part 300 may be provided in a part of the control panel 910. For the sake of aesthetics, when the control panel 910 is rotated to reveal a back side thereof, a through hole (not shown) into which a filter is to be inserted may be provided. In contrast, the first front panel 104 or the second front panel 204 may include the filter door 314, and when a filter door 314 is opened, a filter insertion hole 313 (refer to FIG. 2) into which a filter (not shown) is to be inserted may be provided.

Figure 2:
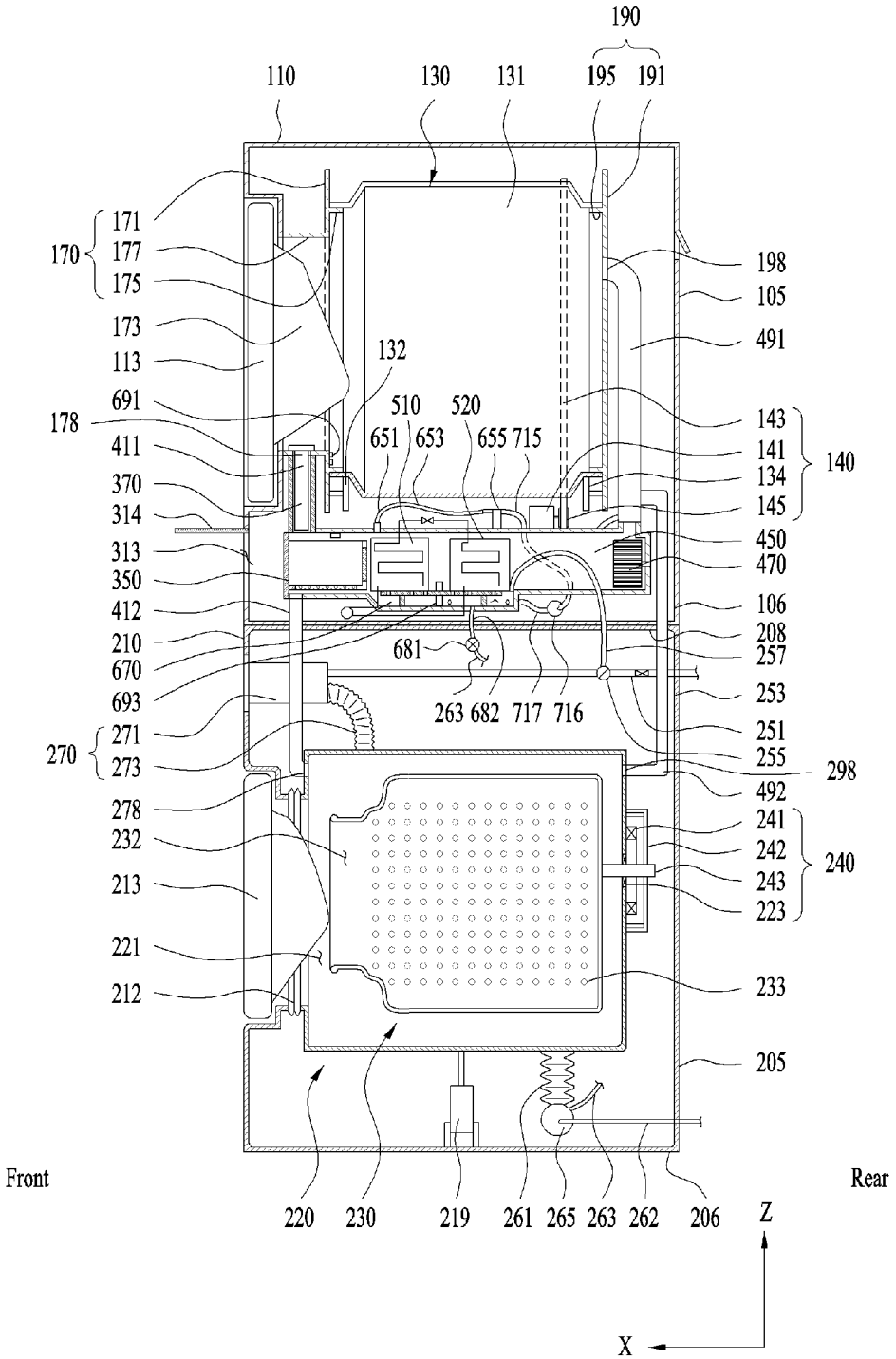
FIG. 2 is a diagram showing one cross-section of a laundry treating apparatus.

FIG. 2 shows one cross section of a laundry treating apparatus 100 that is integrally configured. FIG. 2 shows an embodiment of the present disclosure. First, a first laundry treating apparatus 1000 may be disposed at an upper side and a second laundry treating apparatus 2000 may be disposed at a lower side. The first laundry treating apparatus 1000 may be a dryer, and the second laundry treating apparatus 2000 may be a laundry dryer having a drying function. This is only considering a weight, and unlike this, the upper and lower sides may be reversed. When the second laundry treating apparatus 2000 has a drying function, this means that when the amount of laundry to be dried is small or does not need to be completely dried, it may not be necessary to take out the laundry to be dried from the second laundry treating apparatus 2000 and move the laundry cumbersomely to the first laundry treating apparatus 1000, thereby providing convenience of drying the laundry immediately.

To this end, thus far, the case in which heat exchangers for drying are provided separately has been described, but the feature of the present disclosure relates to integration of the heat exchangers into one and sharing the heat exchangers with each other.

To emphasize a relationship of a second intake duct 412, a second exhaust duct 492, and a connection duct 450, the second intake duct 412, the second exhaust duct 492, and the connection duct 450 are only shown before a detergent storage 270 and a first water supply pipe 271, the detergent storage 270 and the first water supply pipe 271 may not be disconnected by the second intake duct 412 and the second exhaust duct 492.

The laundry treating apparatus 100 may include the first cabinet 110 defining an outer appearance, the first drum 130 having a cylindrical shape with an open front and rear, the second cabinet 210 disposed below the first cabinet, the tub 220 disposed inside the second cabinet 210, a second drum 230 rotatably provided inside the tub to accommodate laundry, a first intake duct 411 for sucking air of the first drum 130, the second intake duct 412 for sucking air of the tub 220, the connection duct 450 including a heat exchanger 500 connected to the first intake duct 411 and the second intake duct 412 to exchange heat with the sucked air, a first exhaust duct 491 for discharging the air heat-exchanged through the heat exchanger 500 to the first drum 130, and the second exhaust duct 492 for discharging the air heat-exchanged through the heat exchanger 500 to the tub 220.

First, the second laundry treating apparatus 2000 disposed at the lower side of the laundry treating apparatus 100 will be described. The second laundry treating apparatus 2000 may include the second cabinet 210 defining an outer appearance, the tub 220 provided inside the second cabinet 210 to store washing water and to perform a drying function, the second drum 230 rotatably provided inside the tub 220 to store laundry, and a second driver 240 for applying torque to the second drum 230 to rotate the second drum 230.

The second cabinet 210 may include a second entrance 211 for loading and unloading laundry, and the second entrance 211 may be opened and closed by the second door 213 rotatably provided in the second cabinet 210.

The tub 220 may include a tub entrance 221 connected to the second entrance 211 and may be fixed to the inside the second cabinet 210 by a tub support 219. The tub support 219 may be a spring or a damper for absorbing vibration of the tub 220.

A gasket 212 is disposed between the tub entrance 221 and the second entrance 211, and the gasket 212 not only prevents washing water inside the tub 220 from being discharged to the outside, but also prevents vibration of the tub 220 from being transferred to the second cabinet 210.

The tub 220 may receive water through a water supply 250, and the water supply may include a first water supply pipe 251 connecting a water source (not shown) and the tub 220, and a water supply valve 253 for opening and closing the first water supply pipe 251. In addition, the tub 220 may define a circulation path including the heat exchanger 500 to dry laundry inside the second drum 230.

Figure 4:
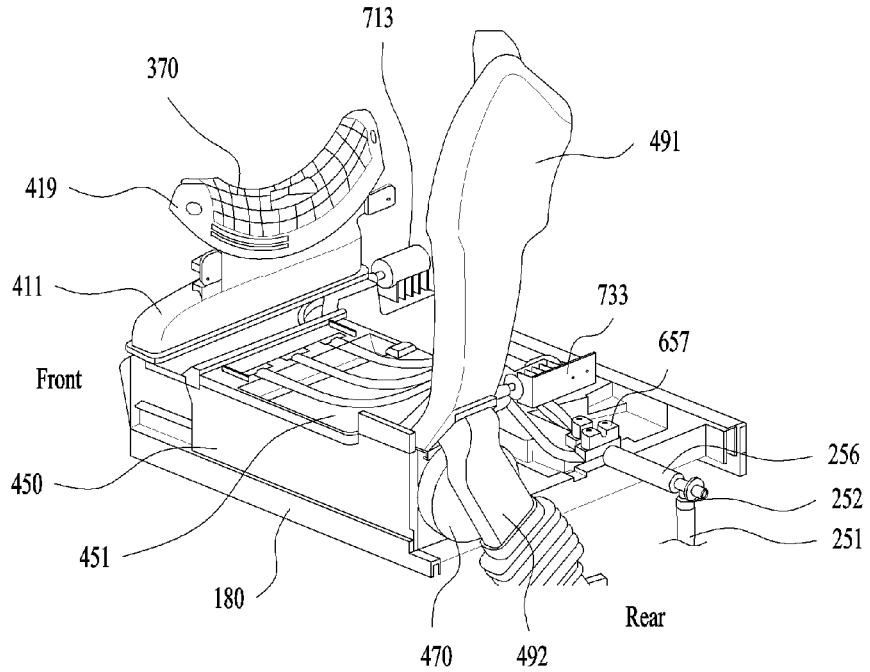
FIG. 4(*a*) shows an example in which a first exhaust duct and a second exhaust duct are connected.
Figure 4:
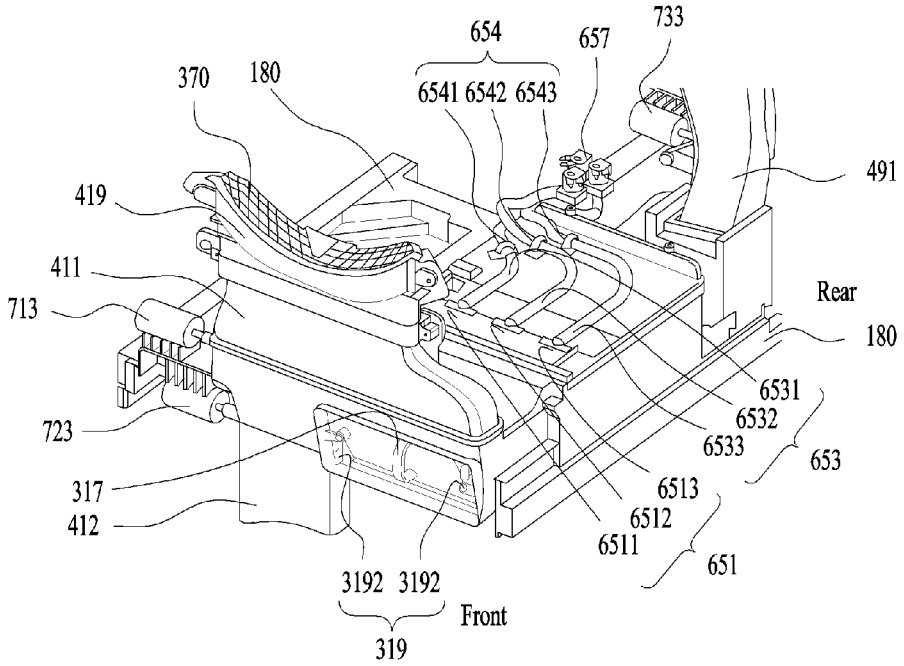

Although the first water supply pipe 251 and the water supply valve 253 are connected to the second cabinet 210 and then connected to the first laundry treating apparatus 1000 through the second water supply pipe, this is only an example, and otherwise, after the first water supply pipe 251 and a second water supply pipe 257 are branched, the second water supply pipe 257 may be connected thereto through the first cabinet 110 (refer to FIG. 4).

The detergent storage 270 for storing detergent may be further disposed in an upper portion of the tub 220, and may include a detergent storage body 271 for storing detergent and a tub supply pipe 273 connecting the detergent storage body 271 to the tub.

In this case, the first water supply pipe 251 may connect a water source (not shown) and the detergent storage body 271. Therefore, when water is supplied through the first water supply pipe 251, the detergent stored in the detergent storage body 271 may be supplied to the tub 220.

In addition, the water supply 250 may supply water passing through the water supply valve 253 to the detergent storage 270 along the first water supply pipe 251 by a first switching valve 255, and may supply water to a condensate storage 670 disposed in a lower portion of the first laundry treating apparatus 1000 along the water supply pipe 257. This is to clean the filter part 300 by directly storing the water supplied for the second laundry treating apparatus 2000 in the condensate storage unit 670 and spraying the water to the filter part 300.

In contrast, water supplied to the first laundry treating apparatus 1000 and the second laundry treating apparatus 2000 may be branched and connected to each other by using a Y-shaped branch pipe (not shown) in an external water source. In this case, the branch pipe (not shown) may be connected to the first water supply pipe 251 and a third water supply pipe 256 (refer to FIG. 3), and water from the external water source may be supplied into the tub 220 through the first water supply pipe 251 or may be connected directly to a spray part 650 to be described later through the third water supply pipe 256. Unlike the second water supply pipe 257, the third water supply pipe 256 may be connected to a second switching valve 655 of the spray part 650 to be described later without going through the condensate storage 670.

The water stored inside the tub 220 may be discharged to the outside of the second cabinet 210 through a drain 260. The drain 260 may include a third drain pipe 263 for guiding the water inside the tub 220 to the outside of the second cabinet 210, and a drain pump 265 connected to the third drain pipe 263. In addition, the drain 260 may include a first drain pipe 261 through which water inside the tub 220 is connected to the drain pump 265, and a second drain pipe 262 for guiding the drained water of the condensate storage 670 of the first laundry treating apparatus 1000 to the drain pump 265.

The second drum 230 provided in the tub 220 may include a second drum entrance 231 connected to the tub entrance 221. Accordingly, the user may put laundry into the second drum 230 or withdraw the laundry from the second drum 230 through the second entrance 211, the tub entrance 221, and the second drum entrance 231.

A plurality of second drum through holes 233 connecting the inside of the second drum 230 to the tub 220 may be further provided on an outer peripheral surface of the second drum 230. Therefore, the water stored in the tub 220 may be supplied to the laundry stored in the second drum 230 through the second drum through holes 233, and the water contained in the laundry may be discharged to the tub 220 through the second drum through holes 233.

The second drum 230 may be rotated by the second driver 240 provided outside the tub 220, and the second driver 240 may include a second motor 246, that is, a stator 242 fixed to a rear surface of the tub 220, a rotor 241 rotated by electromagnetic action with the stator 242, and a rotation shaft 243 connecting the rotor 241 to the rear surface of the second drum 230. As such, in the second drum 230, the rotation shaft 243 of the second motor 246 may be directly connected to the rear surface of the drum, unlike the first drum 130.

The stator 242 may receive electric power from a power supply to form a rotating field, and the rotor 241 may rotate by the rotating field provided by the stator 242. Since rotation of the rotor 241 is transmitted to the second drum 230 through the rotation shaft 243, electric power may be supplied to the stator 242 to provide torque required for rotation of the second drum 230.

The rotation shaft 243 may connect the second drum 230 and the rotor 241 through the rear surface of the tub 220, and in this case, a bearing 223 for rotatably supporting the rotation shaft 243 may be further disposed on the rear surface of the tub 220.

In order for the second laundry treating apparatus 2000 to implement a drying function, the tub 220 not only stores water but also circulates air and requires a circulation duct for heating and dehumidifying. To this end, the tub 220 requires a circulation path including the second intake duct 412 connected to the tub 220 to suck air of the tub 220, the second exhaust duct 492 for discharging the heat-exchanged air back to the tub 220, and the connection duct 450 that connects the intake duct 412 and the second exhaust duct 492 and in which the heat exchanger 500 is disposed.

To this end, the tub 220 may include a second air outlet 278 to connect the second intake duct 412 and the tub 220, and may include a second air inlet 298 to connect the second exhaust duct 492 and the tub 220. Air introduced into the tub 220 may flow into and out of the second drum through the second drum through holes 233 to dry the laundry.

The second intake duct 412 and the second exhaust duct 492 may be exclusive ducts connected to the tub 220, but the connection duct 450 may also be used in the first laundry treating apparatus 1000 to be described later. That is, air sucked from the first intake duct 411 and the second intake duct 412, which will be described later, may be dehumidified and heated by the heat exchanger 500 provided inside the connection duct 450, and may then pass through a fan 470 and may be discharged through the first exhaust duct 491 and the second exhaust duct 492.

The first laundry treating apparatus 1000 disposed at the upper side may include the first cabinet 110, the first drum 130 that is rotatably provided inside the first cabinet to provide a space for storing laundry, the first intake duct 411, the first exhaust duct 491, and the connection duct 450, which circulate air of the first drum 130, and the heat exchanger 500 that is provided inside the connection duct 450 to dehumidify and heat air introduced into the circulation duct 400 and then to resupply the air to the first drum 130.

The circulation duct 400 may include the first intake duct 411, the second intake duct 412, the connection duct 450, the first exhaust duct 491, and the second exhaust duct 492. In addition, the heat exchanger 500 for heat exchange may be provided inside the circulation duct 400, specifically, inside the connection duct 450, and the fan 470 for circulating air using the circulation duct may be disposed therein. A filter for removing foreign substances from the circulated air may be provided in front of the heat exchanger.

The first cabinet 110 may include the first front panel 104 defining a front surface of the first laundry treating apparatus 1000, a first rear panel 105 defining a rear surface of the first laundry treating apparatus, and a first upper panel 108 defining an upper surface of the first laundry treating apparatus.

The first front panel 104 may include a first entrance 111 connected to the first drum 130, and the first entrance 111 may be provided to be opened and closed by the first door 113 that is rotatably coupled to the first cabinet 110.

The first front panel 104 may include a separate control panel (not shown). However, as described above, a control panel 910 for integrally controlling the first laundry treating apparatus 1000 and the second laundry treating apparatus 2000 may be disposed between the first drum 130 and the tub 220 in the front panels 104 and 204 of the first cabinet 110 and the second cabinet 210. This is in consideration of user accessibility.

The control panel 910 may include an input unit (not shown) and a display unit (not shown). The input unit may include an electric power supply request unit for requesting electric power supply to the laundry treating apparatus 100, a course input unit for allowing a user to select a desired course among a plurality of courses, and an execution request unit for requesting start of the course selected by the user. The display unit may include at least one of a display panel for outputting a text and a figure, and a speaker for outputting a voice signal and sound.

When the first drum 130 is provided with a cylindrical first drum body 131 having open front and rear surfaces, a first support 170 for rotatably supporting a front surface of the first drum 130 and a second support 190 for rotatably supporting a rear surface of the first drum 130 may be provided inside the first cabinet 110.

The first support 170 may include a first fixed body 171 fixed inside the first cabinet 110, a first drum entrance 173 that is formed through the first fixed body 171 to connect the first entrance 111 to the inside of the first drum body 131, and a first support body 175 that is provided on the first fixed body 171 and is inserted into a front surface (a first open surface) of the first drum body 131.

The first fixed body 171 may be provided in any shape as long as the first drum entrance 173 and the first support body 175 are provided. The first support body 175 may be provided in a pipe shape protruding from the first fixed body 171 toward the first drum body 131, and a diameter of the first support body 175 may be set to be greater than a diameter of the first drum entrance 173 and to be smaller than a diameter of a front surface of the first drum body 131. In this case, the first drum entrance 173 may be disposed inside a space formed by the first support body 175.

The first support 170 may further include a connection body 177 connecting the first entrance 111 and the first drum entrance 173. The connection body 177 may be provided in a pipe shape extending from the first drum entrance 173 toward the first entrance 111. The connection body 177 may be provided with a first air outlet 178 connected to the circulation duct 400. The circulation duct 400 may include the first intake duct 411 that sucks air from the first drum 130, the first exhaust duct 491 that discharges the air passing through the first intake duct 411 back to the first drum 130, the connection duct 450 that connects the first intake duct 411 and the first exhaust duct 491 and includes the heat exchanger 500 therein, and the second intake duct 412 and the second exhaust duct 492 that are connected to the tub 220.

As shown in FIG. 2, the first air outlet 178 may be a passage for allowing air inside the first drum body 131 to move to the first intake duct 411, and may be provided as a through hole formed through the connection body 177.

As shown in FIG. 2, the second support 190 may include a second fixed body 191 fixed inside the first cabinet 110, and a second support body 195 provided on the second fixed body 191 and inserted into a rear surface (second open surface) of the first drum body 131. The second support 190 may include a first air inlet 198 formed through the second fixed body 191 to connect the inside of the first drum body 131 to the inside of the first cabinet 110. In this case, the circulation duct 400 may be provided to connect the first air outlet 178 and the first air inlet 198.

The first drum body 131 of a cylindrical shape with an empty interior is capable of rotating through a first driver with various types, and FIG. 2 shows an example of the case in which a first driver 140 includes a first motor 141 fixed inside the first cabinet 110, a pulley 145 rotated by the first motor 141, and a belt 143 connecting a circumferential surface of the pulley 145 and a circumferential surface of the first drum body 131.

In this case, the first support 170 may include a first roller 132 for rotatably supporting a circumferential surface of the first drum body 131, and a second support 190 may include a second roller 134 for rotatably supporting the circumferential surface of the first drum body 131.

The circulation duct 400 may include the first intake duct 411 connected to the first air outlet 178, the second intake duct 412 connected to the second air outlet 278, a first exhaust duct 490 connected to the first air inlet 198, the second exhaust duct 492 connected to the second air inlet 298, and the connection duct 450 connecting the first intake duct 411, the second intake duct 412, the first exhaust duct 491, and the second exhaust duct 492.

The heat exchanger 500 may be provided as a variety of devices for sequentially performing dehumidification and heating of air introduced into the circulation duct 400, and FIG. 2 shows an example in which the heat exchanger 500 is a heat pump.

The heat exchanger 500 shown in FIG. 2 may include the fan 470 for moving air along the connection duct 450, a first heat exchanger 510 (a heat absorber) for removing moisture from air introduced to the connection duct 450, and a second heat exchanger 530 (a heater) provided inside the connection duct 450 to heat air passing through the first heat exchanger 510.

The fan 470 may include an impeller 471 provided inside the circulation duct 400, and a blower motor 473 for rotating the impeller 471. The impeller 471 may be provided anywhere in the first exhaust duct 491, the second exhaust duct 492, or the connection duct 450, and FIG. 2 shows an example in which the impeller 471 is provided in the first exhaust duct 491 (or when the impeller 471 is provided behind a second heat exchanger 520).

Accordingly, according to another embodiment, the fan 470 may be disposed in front of the heat exchanger 500, that is, between the filter part 300 and the first heat exchanger 510.

The first heat exchanger 510 may include a plurality of metal plates disposed in a width direction (Y-axis direction) of the connection duct 450 or a height direction (Z-axis direction) of the connection duct, and the second heat exchanger 520 may include a plurality of metal plates disposed along the width direction of the connection duct or the height direction of the connection duct. The first heat exchanger 510 and the second heat exchanger 520 may be sequentially disposed in a direction toward the first exhaust duct 491 or the second exhaust duct 492 from the first intake duct 411 or the second intake duct 412 inside the connection duct 450, and may be connected to each other through a refrigerant pipe 580 defining a circulation path of a refrigerant.

The refrigerant may move along the refrigerant pipe 580 by a compressor 570 disposed outside the circulation duct 400, and the refrigerant pipe 580 may include an expander 550 for adjusting a pressure of the refrigerant passing through the second heat exchanger 520.

The second heat exchanger 520 is a device for cooling the air and evaporating the refrigerant by transferring heat of air introduced into the first intake duct 411 or the second intake duct 412 to the refrigerant. The second heat exchanger 520 is a device for heating air and condensing the refrigerant by transferring heat of the refrigerant passing through the compressor 570 to the air. In this case, when passing through the first heat exchanger 510, moisture contained in air may be collected on a bottom surface of the connection duct 450 along a surface of the first heat exchanger 510.

In order to collect condensed water from air passing through the first heat exchanger 510, the laundry treating apparatus 100 may include the condensate storage 670. FIG. 2 shows an example of the case in which the condensate storage 670 is disposed below the first heat exchanger 510 and the second heat exchanger 520 inside the condensate storage 670. This is to move condensate by gravity without the aid of a mechanism or a mechanical device that forces movement of the condensate.

Figure 3:
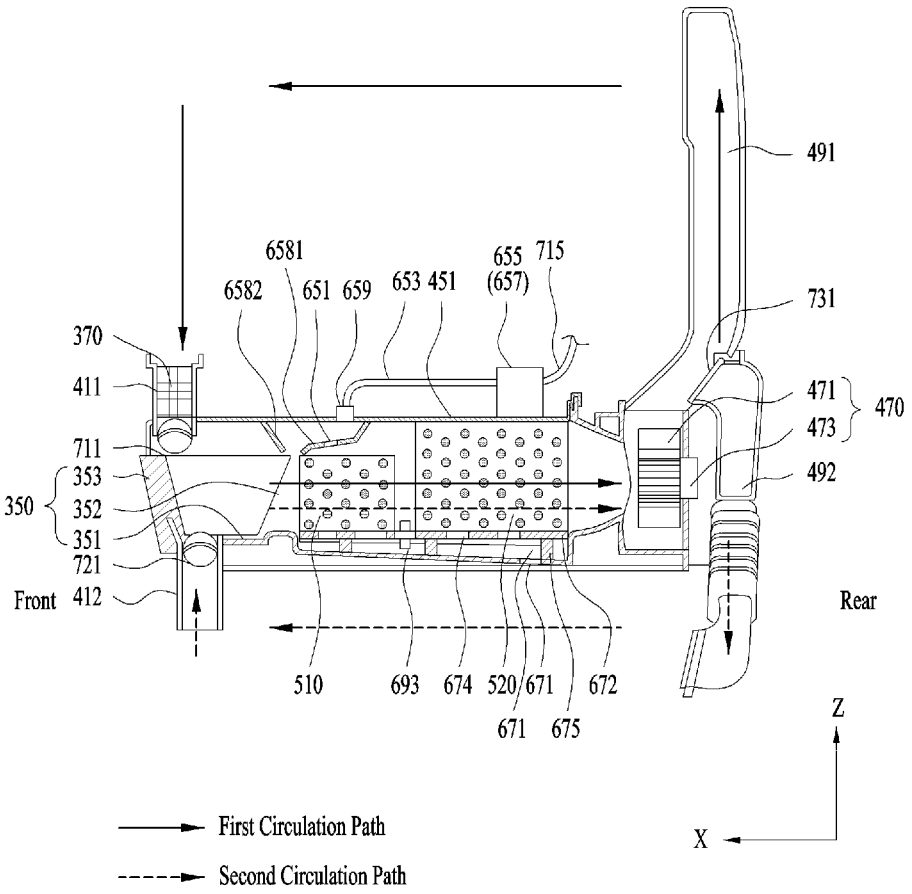
FIG. 3 is a diagram showing an example of a circulation duct including a common connection duct including a heat exchanger.

For explanation, referring to FIG. 3, the condensate storage 670 may include a water collecting body 671 that is fixed to a bottom surface of the connection duct 450 and connected to the inside of the connection duct. To prevent the first heat exchanger 510 and the second heat exchanger 520 from contacting the water (condensate) stored in the water collecting body 671, a heat exchanger support may be further provided inside the water collecting body 671. The heat exchanger support may include a support plate 672 that is in contact with the first heat exchanger 510 and the second heat exchanger 520, a spacer 675 maintaining a gap between the support plate 672 and a bottom surface of the water collecting body 671, and a support plate through hole 674 formed through the support plate 672.

The support plate through hole 674 may be provided only in a space in which the first heat exchanger 510 is supported among spaces provided by the support plate 672, and may also be provided in each of a space in which the first heat exchanger 510 is supported, and a space in which the second heat exchanger is provided. When the support plate through hole 674 is also provided in a lower portion of the second heat exchanger 520, it may be possible to discharge water moving to the second heat exchanger 520 along the support plate 672 to the water collecting body 671. This is to prevent a decrease in heat transfer efficiency that occurs when the second heat exchanger 520 comes into contact with water, as in the first heat exchanger 510.

In order to minimize stacking of foreign substances (lint, etc.) discharged from the first drum body 131 on the first heat exchanger 510 and the second heat exchanger 520, the first laundry treating apparatus 1000 may further include the filter part 300 for filtering air. FIG. 2 shows an example of the case in which the filter part 300 includes a first purifier 350 provided in the connection duct 450 and a second purifier 370 is provided in the first intake duct 410.

The filter part 300 may further include a third purifier (not shown) to filter foreign substances discharged from the tub 220 performing a drying function.

The second purifier 370 may be a device for filtering air introduced into the first intake duct 411 from the first drum body 131, and the first purifier 350 may be a device disposed between the second purifier 370 and the first heat exchanger 510 and between the third purifier (not shown) and the first heat exchanger 510 to filter air passing through the second purifier 370.

The first purifier 350 may be detachably provided in the connection duct 450. In this case, the first front panel 104 of the first cabin may include a filter insertion hole 313 (refer to FIG. 2) from which the first purifier 350 is drawn out (refer to FIG. 2) and the filter door 314 for opening and closing the filter insertion hole 313, and the connection duct 450 may include a duct through hole 315 (refer to FIG. 4(*b*)) into which the first purifier 350 is inserted. Accordingly, a user may remove the foreign substances remaining in the first purifier 350 and may wash the first purifier after separating the first purifier 350 from the laundry treating apparatus as needed.

As shown in FIG. 3, the first purifier 350 may include a first frame 353 inserted into the duct through hole 315 and disposed between the second purifier 370 and the first heat exchanger 510, and filters 351 and 352 provided in the first frame 353 to filter a fluid (air and water) moving to the first heat exchanger 510 and the water collecting body 671.

The first frame 353 may be provided in various forms depending on a shape of a cross-section (Y-Z plane, and X-Z plane) of the connection duct 450, and FIG. 2 shows an example in which the first frame 353 has a shape similar to a hexahedron.

In this case, a first filter inlet for introducing air passing through the second purifier 370 into the first frame 353 may be provided on an upper surface of the first frame 353, and a handle 317 protruding toward the filter insertion hole 313 may be provided on a front surface of the first frame 353. The filters 515 and 517 may include a first filter 351 provided on a rear surface of the first frame 353 and a second filter 352 provided on a bottom surface of the first frame 353. A rear surface of the first frame may refer to a surface facing the first heat exchanger 510 among spaces formed by the first frame 353, and a bottom surface of the first frame may be set to be a surface directed toward the bottom surface of the connection duct 450 to face the filter inlet.

A second filter inlet for introducing air passing through the third purifier (not shown) into the first frame 353 may be provided in a lower surface of a first frame 354.

The second purifier 370 may include a second frame 371 that is detachably inserted into the first intake duct 411 through the first air outlet 178, and a third filter 373 provided in the second frame to filter air. Diameters of filter holes provided in the first filter 351 and the second filter 352 may be set to be smaller than a diameter of a filter hole provided in the third filter 373. Thus, first, foreign substances having a relatively large size are filtered by the third filter, and then, foreign substances having a relatively small size may be filtered through the first filter 351 and the second filter 352 again.

As shown in FIG. 2, the first laundry treating apparatus 1000 may further include the spray part 650 for washing the first purifier 350 using water stored in the water collecting body 671, and the drain 260 for discharging water inside the water collecting body 671 to the outside of the water collecting body 671.

As shown in FIG. 2, the spray part 650 may be a device for washing at least one of the first filter 351, the second filter 352, and the first heat exchanger 510 by spraying water stored in the water collecting body 671 to the first purifier 350. The spray part 650 may include the spray part 650 provided in the connection duct 450 to supply water to the first purifier 350, and a water supply pump 716 for moving water stored in the water collecting body 671 to the spray part 650.

The water supply pump 716 may be connected to the water collecting body 671 through a water supply pump connection pipe 717 and may be connected to the spray part 650 through a storage water supply pipe 715.

The spray part 650 may be provided as a nozzle fixed to the connection duct 450 to spray water to the first filter 351 and the second filter 352, or may also be provided as a nozzle for spraying water to each of the first filter 351, the second filter 352, and a front surface of the first heat exchanger 510.

The reason for washing through the spray part 650 is to prevent foreign substances from being attached to the first filter 351, the second filter 352, and the first heat exchanger 510 to degrade filtration performance of a filter and heat exchange performance of the heat exchanger, and to prevent hygiene problems from being caused.

FIG. 3 shows an example in which the spray part 650 includes a connection duct through hole 652 formed through the connection duct 450 and connected to a spray pipe 653, a first guide 6581 for guiding supplied from the connection duct through hole 652 to the first filter 351, and a second guide 6582 for guiding at least a portion of water supplied through the first guide 6581 to the front surface of the first heat exchanger 510. In this case, the second guide 6582 may be a device for supplying water to the front surface of the first heat exchanger 510 through the first filter 351. That is, the first filter 351 may be disposed between the first guide 6581 and the second guide 6582 when the first purifier 350 is fixed to the connection duct 450, and the second guide 6582 may be an inclined surface that is inclined downward toward the first filter 351 from an upper surface of the connection duct 450.

The first guide 6581 may further include a guide through hole 659. The guide through hole 659 may be a hole formed through the first guide 6581 and may supply water introduced into the connection duct through hole 652 to a front region of the first heat exchanger 510 through the guide through hole 659. The front region of the first heat exchanger may refer to a region positioned toward the first filter 351 based on a vertical line passing through the center of the first heat exchanger 510.

The aforementioned laundry treating apparatus 100 may have an effect for washing the first purifier 350 and the first heat exchanger 510 through water stored in the water collecting body 671 during an operation of the heat exchanger 500, but when the amount of the water stored in the collecting body 671 is small, there may be a problem in that washing of the first purifier 350 and the first heat exchanger 510 is not performed. This is because, when the amount of laundry put into the first drum body 131 is small, the amount of water collected in the water collecting body 671 during an operation of the heat exchanger 500 is small, and when the amount of water stored in the water collecting body is small, it is not possible to supply water with an amount sufficient to wash the purifier 350 and the first heat exchanger 510.

To solve the above problem, the laundry treating apparatus 100 may supply water to the water collecting body 671 of the condensate storage 670 using an external water source required for the second laundry treating apparatus 2000.

Referring to FIG. 2, the water supply 250 may include the first water supply pipe 251 connected to an external water source and the water supply valve 253 for opening and closing the first water supply pipe 251. The first water supply pipe 251 and the water supply valve 253 may be necessary for a washing function of the first laundry treating apparatus 1000, but may be used to ensure the amount of water sufficient for washing the first purifier 350 of the filter part 300 and washing of the first heat exchanger. To this end, water passing through the water supply valve 253 may be supplied to the first laundry treating apparatus 1000 or the second laundry treating apparatus 2000 through the first switching valve 255.

That is, the first switching valve 255 may be a valve for switching a water supply direction by selecting one of the tub 220 or the condensate storage 670. A controller (not shown) may supply water to one of the second laundry treating apparatus 2000 and the first laundry treating apparatus 1000 through the first switching valve 255. However, unlike this, while water is being supplied to the first laundry treating apparatus 1000, water may be supplied to the second laundry treating apparatus 2000 when necessary.

A flow path when water is supplied to the water collecting body 671 of the condensate storage 670 through the first switching valve 255 will be described below. The second water supply pipe 257 may be disposed between the first switching valve 255 and the water collecting body 671, and may connect the first switching valve 255 and the water collecting body 671. Water passing through the first switching valve 255 may be supplied to the water collecting body 671 through the second water supply pipe 257.

The water supplied as such may be used to wash the first heat exchanger 510 or the first purifier 350 of the filter part 300, specifically, the first filter 351 and the second filter 352 using the spray part 650.

A flow path of the spray part 650 will be described now, and may include the water supply pump 716 for supplying water stored in the water collecting body 671, the water supply pump connection pipe 717 may be connected between the water collecting body 671 and the water supply pump 716, and the spray part 650 and the water supply pump 716 may be connected by the storage water supply pipe 715.

The spray part 650 may be installed above a connection duct upper plate 451 defining an upper body of a connection duct. The spray part 650 may include a spray nozzle 651 for spraying water for washing the first heat exchanger 510 or the first purifier 350, and the spray pipe 653 connecting the spray nozzle 651 and the storage water supply pipe 715.

Due to a compact structure of the laundry treating apparatus, the size of the water collecting body 671 of the condensate storage 670 may not be large. In this case, the capacity of the water supply pump 716 may be limited. To overcome this limitation and to evenly spray water to the first heat exchanger or the first purifier 350, the spray nozzle 651 may be provided in a plural number, and thus may include the same number of the spray pipes 653 as the spray nozzles 651. In order to spray water while maintaining a sufficient water pressure, it may be possible to selectively spray water into one of the plurality of the sprays pipe 653 rather than supplying water through each the spray pipe 653 at the same time.

In addition, when it is determined that a specific area of the first heat exchanger 510 or the filter part 300 has a high degree of contamination, only the area with a high degree of contamination may be washed via spraying.

In the first heat exchanger 510 or the first purifier 350, when it is determined that an area washed by spraying water by a first spray nozzle 6511 has a high degree of contamination, a controller needs to wash only a corresponding part using the first spray nozzle 6511.

If there are the plurality of spray nozzles 651, water may be supplied through the corresponding spray pipe 653 by selecting each spray nozzle. In addition, the spray nozzles 651 may also sequentially spray water.

Referring to FIG. 3, when there are three spray nozzles, water is first supplied to the first spray nozzle 6511 to spray water, when a predetermined time elapses, water is supplied to a second spray nozzle 6512 to spray water, and when a predetermined time elapses again, water is supplied to a third spray nozzle 6513 to spray water.

For the aforementioned spraying method, the storage water supply pipe 715 may be connected to the plurality of spray pipes 653 through the second switching valve 655 rather than being connected directly to the plurality of spray pipes 653.

That is, the second switching valve 655 may switch a direction of water to supply water to each spray pipe for a preset time by the controller. For example, the second switching valve may be a three-way solenoid valve and the like.

Therefore, when water of the water collecting body 671 is not sufficient, the controller may control the first switching valve 255 and the second water supply pipe to receive water of the condensate storage 670, and, if necessary, may wash the first purifier 350 or the first heat exchanger 510 through the water supply pump 716, the storage water supply pipe 715, the second switching valve 655, the spray pipe 653, and the spray nozzle 651 using the water stored in the water collecting body 671.

In contrast, water may be directly supplied to the spray part 650 through a branch pipe (not shown) without going through the water collecting body 671, which will be described below with reference to FIG. 3.

As shown in FIG. 2 or 3, the laundry treating apparatus 100 may include a water level detector 693 for measuring a water level of the water collecting body 671 and transmitting the result to the controller. When the water level detector 693 is provided, the laundry treating apparatus may drain water stored in the water collecting body 671, thereby preventing water of the water collecting body 671 from flowing back into the connection duct 450. In addition, during washing of the filter part and/or the first heat exchanger through the spray part 650, if water supply is larger than drainage due to clogging or high water pressure, a water level in the water collecting body 671 of the condensate storage 670 may go up to back flow without going down, thereby preventing a backflow problem in advance.

The water level detector 693 may be provided with any device that is capable of detecting a water level inside the water collecting body 671, and FIG. 3 shows an example of a sensor including a plurality of electrodes (a plurality of electrodes that are electrically connected depending on a water level) with different lengths. In contrast, a water level may be determined by detecting the position of a floater that is provided on a bottom surface of the water collecting body 671 and ascends and descends according to the water level.

When the water level measured through the water level detector 693 is less than a preset reference water level, the controller provided in the laundry treating apparatus may open the water supply valve 253, and may switch the first switching valve 255 to supply water to the water collecting body 671 through the second water supply pipe 257 and the storage water supply pipe 715. The water supplied as such may be supplied to the spray part 650 using the water supply pump 716.

As such, the laundry treating apparatus 100 may be capable of minimizing a problem that the first purifier 350 or the first heat exchanger 510 is not washed due to insufficient water of the water collecting body 671. That is, this is to satisfy a reference water level for always ensuring washing performance to the maximum by supplementing water required for washing.

The above-described laundry treating apparatus may drain water stored in the water collecting body 671 only with the water level detector 693 through the drain 260, or may control a time point at which water is supplied to the condensate storage 670 by controlling an operating time point and operating time period of the water supply valve 253 for opening and closing the first water supply pipe 251.

Water sprayed through the spray part 650, water condensed through the heat exchanger 500, and water stored in the condensate storage 670 through the water supply 250 are all stored in the water collecting body 671. Accordingly, according to a storage capacity of the water collecting body 671 while performing a drying function of the first laundry treating apparatus 1000, only the condensate may exceed a full water level. In this case, it may be necessary to drain the water to prevent backflow of the stored water.

In addition, when the first purifier and/or the first heat exchanger are washed through the spray part 650, the water level needs to go down because water of the condensate storage 670 is used. However, when drainage is blocked or water pressure is higher than drainage, a water level in the water collecting body 671 of the condensate storage 670 may not go down, and thus this may be determined through the water level detector 693 and water may be drained.

The drain 260 is described now with reference to FIG. 3, and the drain 260 may include a drain hole 672 provided on a bottom surface of the water collecting body 671, a drain valve 681 that is opened and closed by a controller to drain water of the water collecting body, a drain valve connecting pipe 682 connecting the drain valve 681 and the drain hole 672, the first drain pipe 261 for draining water of the tub 220 to the drain pump 265, the second drain pipe 262 for draining water discharged by the drain pump to the outside, and the third drain pipe 263 connecting the drain valve 681 and the drain pump 265.

Here, the drain pump 265 does not simply refer to a pump used to transport water, but the drain pump 265 may include a drain pump housing (not shown) connected to the first drain pipe 261 or the third drain pipe 263 to provide a space for storing water, a drain pump impeller (not shown) rotatable inside the first housing, a drain pump motor (not shown) for rotating the drain pump impeller, and a drain pump outlet (not shown) formed through a circumferential surface of the drain pump housing and connected to the second drain pipe 262.

Even if a water level of the water collecting body 671 is not high, it may be necessary to discharge water remaining in the water collecting body 671 of the condensate storage 670 when a washing process of the heat exchanger and the filter part is finished or a drying cycle is finished. This is to prevent hygiene and odor problems in the laundry treating apparatus 100 in advance. Even in this case, all remaining water may be discharged using the drain hole 672 formed in a bottom surface of the water collecting body 671.

The laundry treating apparatus disclosed herein may further include a controller (not shown). The controller may be disposed anywhere as long as the controller is capable of controlling the laundry treating apparatus. In general, the controller may be installed invisibly behind the control panel 910, but is not limited thereto. The controller may control rotation of the first drum 130 and the second drum 230, may determine a dryness through a dryness detector 691, and may wash the first heat exchanger 510 and/or the filter part 300 using the water supply valve 253, the first switching valve 255, the second switching valve 655, and the water supply pump 716 of the water supply 250. In addition, the water level may be measured through the water level detector 693 of the water collecting body 671, the drain valve 681 may be opened when the water level is full, and after draining, the drain pump 265 may be controlled to discharge water to the outside.

In addition, as necessary, the controller (not shown) may control opening and closing of a first opening/closing unit 710, a second opening/closing unit 720, and a third opening/closing unit 730, which will be described below, to circulate air of the first laundry treating apparatus 1000, to circulate air for a drying cycle of the second laundry treating apparatus 2000, or to circulate air at the both sides.

As shown in FIG. 2, the laundry treating apparatus 100 may include dryness detectors 691 and 692 to determine a time to stop an operation of the heat exchanger 500 by determining the dryness of laundry. The dryness detectors 691 and 692 may include at least one of an electrode sensor 691 that is in contact with laundry to measure the amount of moisture contained in the laundry, and a humidity sensor 692 for measuring humidity of air flowing into the circulation duct 400 from the first drum 130.

As shown in FIG. 3, the electrode sensor 691 may include two electrodes that are fixed to the first fixed body 171 to be in contact with laundry inside the first drum body 131. As a dryness increases, the amount of moisture contained in the laundry may decrease (the electrical resistance of the laundry increases), and thus the laundry treating apparatus 100 may determine the dryness of the laundry by observing the electrical resistance measured when the two electrodes are connected by the laundry.

As the dryness of the laundry increases, the amount of moisture contained in air introduced into the circulation duct 400 may be reduced, and accordingly, the laundry treating apparatus 100 may determine the dryness of laundry by observing the humidity of the air introduced into the first intake duct 411 or the second intake duct 412 through the humidity sensor 692.

In order to determine the dryness of the laundry, unlike FIG. 3, a separate humidity sensor may be provided for each intake duct.

If the dryness that is measured through the dryness detector 691 after rotation of the first drum 130 is started to start a drying cycle is above a preset reference dryness, the controller may control the water supply 250 to supply water to the condensate storage 670 when the water level detector 693 determines the amount of water currently stored in the storage 670 to be insufficient. When the amount of the water is not insufficient, the spray part may spray water immediately, but the amount of water stored in the water collecting body is smaller than the amount for washing, water needs to be added during spraying. In this case, similarly, when the amount of water currently stored in the condensate storage 670 is determined to be insufficient through the water level detector 693, the controller may control the water supply 250 to supply water to the condensate storage 670.

Although not shown in the drawings, the laundry treating apparatus 100 may further include a laundry weight detector for determining the amount of laundry stored inside the first drum body 131. The laundry weight detector may be a device for transmitting the amount of current supplied to the first motor 141 of a driver to the controller to rotate the first drum body 131 at a constant number of revolutions, or may be a device for transmitting information on the number of revolutions of the first drum body 131 to the controller when supplying current with a constant magnitude to the first motor 141 for a predetermined period of time.

When the laundry weight detector is provided, the controller may predict the amount of condensate to be generated from laundry accommodated in the first drum by detecting the amount of laundry. When it is determined that the amount of the generated condensate is smaller than the amount required for washing the first purifier 350 or the first heat exchanger 510, the insufficient water may be added through an external water source before cleaning the first purifier 350 or the first heat exchanger 510.

If it is determined that the amount of water stored in the water collecting body 671 is greater than the amount of water required for washing the first purifier 350 or the first heat exchanger 510, that is, when the amount of water stored in the water collecting body 671 exceeds a preset reference water level through the water level detector 693, the controller may drain water by opening the drain valve 681.

FIG. 3 shows an example of a circulation duct including a common connection duct including a heat exchanger. As described above, the circulation duct 400 may include the first intake duct 411 connected to the first air outlet 178, the second intake duct 412 connected to the second air outlet 278, the first exhaust duct 491 connected to the first air inlet 198, the second exhaust duct 492 connected to the second air inlet 298, and the connection duct 450 connecting the first intake duct 411, the second intake duct 412, the first exhaust duct 491, and the second exhaust duct 492.

The heat exchanger 500 may be disposed inside the connection duct 450, and the connection duct 450 may include the fan 470 for circulating air of the tub 220 or the first drum 130. In addition, the filter part 300 for filtering foreign substances from the air of the tub 220 or the first drum 130 may be disposed inside the connection duct 450.

A structure for forming a circulation path by opening and closing the circulation duct 400 for forming a circulation path for performing a drying function of the first laundry treating apparatus 1000 and the second laundry treating apparatus 2000 will be described.

For this, the circulation duct 400 may further include the first opening/closing unit 710 for opening and closing the first intake duct 411, the second opening/closing unit 720 for opening and closing the second intake duct 412, and the third opening/closing unit 730 that is disposed at a connection portion between the first exhaust duct 491 and the second exhaust duct 492 and selectively branches the first exhaust duct 491 and the second exhaust duct 492.

By independently driving the first opening/closing unit 710, the second opening/closing unit 720, and the third opening/closing unit 730, the first intake duct 411, the connection duct 450, and the first exhaust duct 491 may form a first circulation path to circulate air of the first drum, or the second intake duct 412, the connection duct 450, and the second exhaust duct 492 may form a second circulation path to circulate air of the tub 220. In addition, the first circulation path and the second circulation path may be simultaneously opened or closed.

The inside of the connection duct 450 may include the filter part 300 in front of the first heat exchanger 510. The fan 470 may be provided behind the second heat exchanger 520 to forcibly circulate air of the tub 220 and the first drum 130. The fan 470 is shown to be disposed at an end of the first exhaust duct 490 connected to the connection duct 450, but even if the fan 470 is installed elsewhere, the fan 470 may be disposed anywhere as long as air of air of the tub 220 and the second drum 230 is circulated.

The fan 470 may include the impeller 471 inside the circulation duct 400, and the blower motor 473 for rotating the impeller 471. The impeller 471 may be provided anywhere in the first exhaust duct 490, the connection duct 450, and the second exhaust duct 492, and FIG. 2 shows an example in which the impeller 471 is provided in the exhaust duct 490 (when the impeller 471 is disposed behind the second heat exchanger 520).

The first intake duct 410 may suck air through the first air inlet 198 formed in the connection body 177. The second intake duct 412 may suck air through the second air inlet 298. In a front surface of the connection duct 450, the duct through hole 315 may be connected to the filter insertion hole 313 to insert or separate the first purifier 350. The connection duct 450 may include the duct through hole 315 into which the spray nozzle 651 is inserted, and may spray water to wash the first purifier 350 or the first heat exchanger 510. Further, the connection duct 450 may include a first connection hole 456 connected to the first intake duct 410, a second connection hole 457 connected to the second intake duct 412, and a third connection hole 458 connected to the first exhaust duct 490. The first exhaust duct 490 may include a communication hole 493 connected to the second exhaust duct 492, and may be connected to the second exhaust duct 492 through the communication hole 493.

The circulation duct 400 may include the first opening/closing unit 710 for opening and closing the first intake duct 410 in the vicinity of the first connection hole 456, the second opening/closing unit 720 for opening and closing the second intake duct 412 in the vicinity of the second connection hole 457, and the third opening/closing unit 730 for opening and closing the communication hole 493. A first circulation path circulating a first drum and/or a second circulation path circulating a tub may be formed through the first opening/closing unit 710, the second opening/closing unit 720, and the third opening/closing unit 730. In addition, this may be controlled by the controller (not shown).

That is, when air of the first drum 130 is circulated, the first opening/closing unit 710 may be opened, the second opening/closing unit 720 may be closed to open the first intake duct 410, the second intake duct 412 may be closed, and the first exhaust duct 490 may be opened with the third opening/closing unit 730 to close the second exhaust duct 492. In contrast, when air of the tub 220 is circulated, the second opening/closing unit 720 may be opened, the first opening/closing unit 710 may be closed to open the second intake duct 412, and the first intake duct 410 may be closed, and the second exhaust duct 492 may be opened and the first exhaust duct 490 may be closed with the third opening/closing unit 730.

In order to circulate air at the both sides, the third opening/closing unit 730 may be opened by a predetermined angle, and then both the first opening/closing unit 710 and the second opening/closing unit 720 may be opened to form both the first circulation path and the second circulation path.

Unlike opening and closing of the first exhaust duct 490 and the second exhaust duct 492 using the third opening/closing unit 730, the first intake duct 410 and the second intake duct 412 may have the first opening/closing unit 710 and the second opening/closing unit 720 that are respectively opened and closed. This is because the first purifier 350 needs to inserted or separated through the duct through hole 315 provided in a front surface of the connection duct and the filter insertion hole 313 provided in a front surface of the laundry treating apparatus 100, and thus the first opening/closing unit 710 and the second opening/closing unit 720 for respectively opening and closing the first intake duct 410 and the second intake duct 412 may be separately provided to prevent interference with the first purifier 350.

In contrast, since there is no such detachable component behind the connection duct 450, the connection duct 450 may be connected to the first exhaust duct 490 through the third connection hole 458 provided at an end of the connection duct 450, and may be connected to the second exhaust duct 492 through the communication hole 493 of the first exhaust duct, and accordingly, opening and closing of the first exhaust duct 490 and the second exhaust duct 492 may be controlled with only the third opening/closing unit 730.

The first exhaust duct 490 and the second exhaust duct 492 may be connected through the first air inlet 198 and the second air inlet 298, respectively.

FIG. 4(*a*) shows an example in which a first exhaust duct and a second exhaust duct are connected. FIG. 4(*b*) shows an example in which a first intake duct and a second intake duct are connected to a filter part provided in a connection duct. FIGS. 4(*a*) and 4(*b*) show an example in which the spray part 650 including the plurality of spray nozzles 651 is directly connected to an external water source.

The drawings show the case in which an external water source is directly connected to the spray pipe 653 and the spray nozzle 651 through a third switching valve 657. Here, three spray pipes 6531, 6533, and 6535 may be connected to three spray nozzles 6511, 6512, and 6113, respectively, and the third switching valve 657 may connect each spray pipe to the third water supply pipe 256 at a predetermined time interval and may spray water thereto.

This is because water pressure of water is different depending on an environment in which the laundry treating apparatus 100 is used, and thus a spray pressure is maintained constant in any environment to achieve the same effect. That is, the third switching valve 657 may be used to connect only one spray pipe at one time by selectively selecting each spray pipe rather than spraying water pressure by connecting three spray pipes at the same time.

The three spray pipes 6531, 6533, and 6535 may each be fixed to an upper plate 451 of the connection duct by a fixing part 654 to prevent each of spray pipes 6531, 6533, and 6535 from shaking under water pressure. A first fixing part 654 may be connected from the third switching valve 657 to fix the spray pipe 653 when passing over the upper plate, and a second fixing part 656 may fix a portion of the spray pipe 653 at which the spray nozzle 651 is disposed.

The upper plate 451 may be a part defining a body of the connection duct. The body of the connection duct may be divided into the upper plate 451 and a lower plate (not shown), and the lower plate may not be formed separately, but when a portion of the base 180, in which the connection duct is positioned, is injected, a shape of the lower plate may be ejected together. Here, the upper plate 451 may be combined to form a flow path through which air passes.

The spray nozzle 651 may be inserted into the connection duct through the connection duct through hole 652 to spray water to the first heat exchanger and/or the first purifier 350.

The plurality of the spray nozzle 651 may be provided to be arranged side by side in left and right directions of the connection duct 450 on the upper plate 451 as shown. The left-right direction of the connection duct 450 may be a direction perpendicular to a direction in which air flows inside the connection duct 450. When water is sequentially sprayed through the plurality of the spray nozzles 651, each of spray nozzle 6511, 6512, and 6513 may wash a part of the first heat exchanger 510 and/or the first purifier 350 in a sprayed area. When all of the plurality of spray nozzles 651 sequentially performs spaying, as a result, a front area of the first heat exchanger 510 and/or the first purifier may be washed.

In contrast, the spray nozzles 651 may simultaneously perform spraying and washing. In addition, washing may be repeatedly performed. That is, the third switching valve 657 may switch a direction of water to supply water to each spray pipe for a time preset by a controller. A 3 way solenoid valve or the like may be used as the third switching valve 657. The third switching valve 657 or the second switching valve 655 may have different names depending on whether it is directly connected to an external water source but may have the same feature of sequentially or selectively passing the supplied water through the plurality of spray pipes 653 to the plurality of spray nozzles 651.

FIG. 4(*a*) shows a form in which the second purifier 370 is coupled to the first intake duct 410. The second purifier 370 may be inserted and mounted in the first intake duct 410, but according to an embodiment, in FIG. 4(*a*), the first intake duct 410 includes a filter guide 419, and the second purifier 370 may be inserted into the filter guide 419. A curved surface of an upper portion of the filter guide 419 may have the same radius of curvature to form a smooth circle along an inner circumferential surface when coupled to the circular connection body 177. An upper part of the second purifier 370 also forms the same curved surface.

The height of the first intake duct 410 is lower than that of the first exhaust duct 490 because the first intake duct 410 sucks air from a lower part of the connection body 177. The first exhaust duct 490 may be connected to the first drum 130 through the first air inlet 198 provided on the upper part of the second support 190.

FIG. 4(*a*) shows an example in which the connection duct 450, the spray part 650, and the like are installed on a base 180. The connection duct 450 needs to have a duct shape to form a circulating air path, and thus a lower part of the duct may be formed by the base 180, and an upper part of the duct may be formed by the upper plate 451. That is, when the base is injected, the lower part of the duct may be already formed, and here, the upper plate 451 may be combined here to have the overall duct shape. Before the upper plate 451 is combined, the fan 470, the first heat exchanger 510, the second heat exchanger 520, the refrigerant pipe 580, and the like may be installed, and the spray nozzle 651 may be inserted into the upper plate 451 through the connection duct through hole 315 to fix the spray pipe 653. The third switching valve (not shown) may also be fixed.

Referring to FIG. 4(*a*), the second exhaust duct 492 may be connected to a lower portion of the first exhaust duct 490. To simplify a flow path as much as possible, the second exhaust duct 492 may be connected to the first exhaust duct as soon as the second exhaust duct 492 passes the heat exchanger 500 and the fan 470. The first exhaust duct may include the communication hole 493, and the communication hole 493 may have the third opening/closing unit 730 to open and close the communication hole 493. The third opening/closing unit 730 may be rotatably coupled into the first exhaust duct 490. That is, the third opening/closing unit 730 rotates only inside, and a position when the communication hole 493 is closed may be referred to as a first position, and in this case, an angle with the communication hole 493 may be determined as 0 degrees (°).

Referring to FIG. 4(*b*), the first intake duct 410 may be disposed above the filter insertion hole 313. The second intake duct 412 may be disposed below the filter insertion hole 313. The first opening/closing unit 710 may be disposed at an end of the first intake duct 410, at which the first intake duct 410 is connected to the connection duct 450. In addition, the second opening/closing unit 720 may be disposed at an end of the second intake duct 412, at which the second intake duct 412 is connected to the connection duct 450. Unlike the third opening/closing unit 730, a part for opening and closing the first intake duct 410 and the second intake duct 412 may be divided into the first opening/closing unit 710 and the second opening/closing unit 720 in order to ensure a space into which the first purifier 350 positioned in front is inserted.

Therefore, when the first opening/closing unit 710 is opened, the first intake duct 410 may move air sucked through an upper portion of the first purifier 350 to the connection duct 450. The second intake duct 412 may not be connected to a lower portion of the first purifier 350 or a lower portion of the filter insertion hole 313 to avoid interference with the filter part 300, specifically, the first purifier 350. As shown in FIG. 4(*b*), the second intake duct 412 may be connected to the outside of the filter insertion hole to move the sucked air to the connection duct 450 through a lateral surface of the first purifier 350.

In contrast, when the second opening/closing unit 720 is opened, the second intake duct 412 may move air to the connection duct 450 through a lower portion of the first purifier 350.

Accordingly, the width of the first intake duct 410 may be greater than the width of the second intake duct 412. The width of the first intake duct 410 may be similar to the sum of the second intake duct and the filter insertion hole 313.

The filter insertion hole 313 may be opened by the filter door 314, and the filter door 314 may include the handle 317 for rotating the filter door 314 and a filter fixing part 319 for inserting the first purifier 350 and closing and then fixing the filter door 314.

The first opening/closing unit 710 may include a first blocker 711 for opening and closing the first intake duct 410, and a first opening/closing driver 713 connected to the first blocker 711 to rotate the first blocker 711 and to open and close the first intake duct 410. Similarly, the second opening/closing unit 720 may include a second blocker 721 for opening and closing the first intake duct 410, and a second opening/closing driver 723 for rotating the first blocker 711 to open and close the second intake duct 412. The third opening/closing unit 730 may also include a third blocker 731 for opening and closing the first exhaust duct 490 and the second exhaust duct 492, and a third opening/closing driver 733 for rotating the third blocker 731.

The first opening/closing driver 713, the second opening/closing driver 723, and the third opening/closing driver 733 may include a motor for transferring torque. As an example of the motor, a geared motor using DC power may be used.

Figure 5:
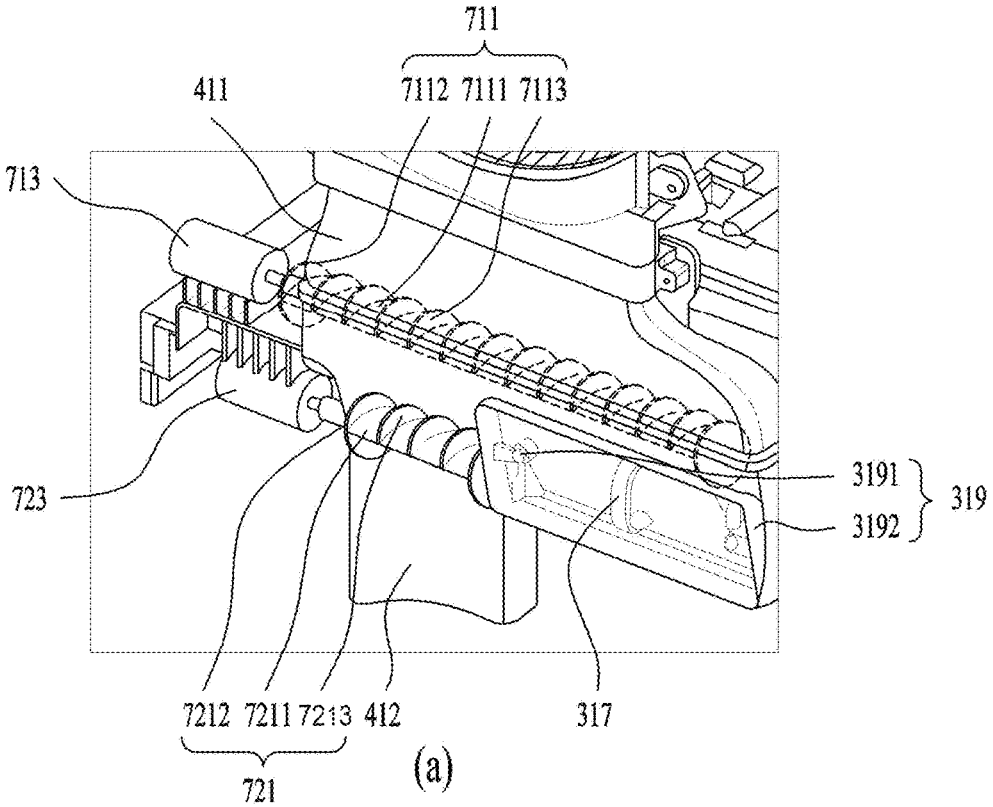
FIG. 5(*a*) shows an example of a first opening/closing driver and a second opening/closing driver between a first intake duct and a connection duct and between a second intake duct and a connection duct.
Figure 5:
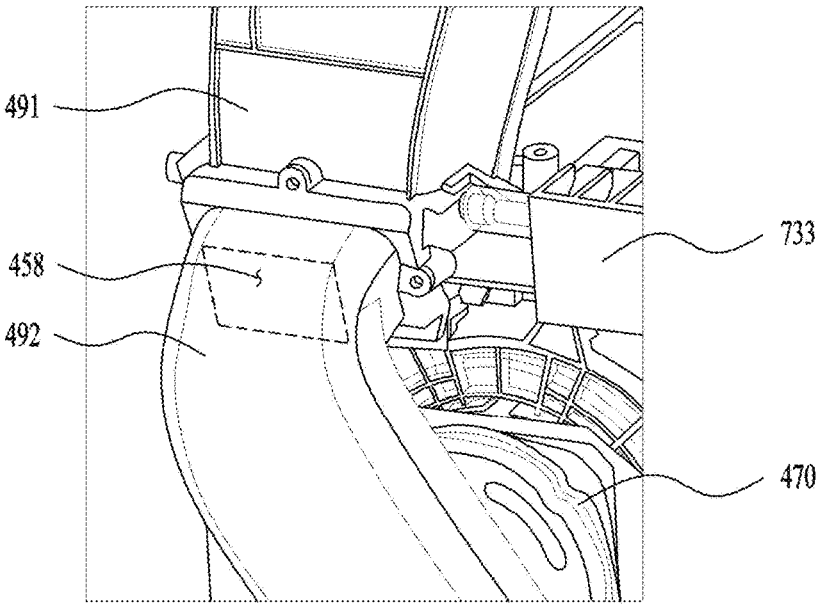

FIG. 5(*a*) shows the first blocker 711 and the first opening/closing driver 713, and the second blocker 721 and the second opening/closing driver 723 between the first intake duct 410 and the connection duct 450, and between the second intake duct 412 and the connection duct 450.

The first blocker 711 has a shape in which a circular cylinder is positioned sideways. Specifically, the first blocker 711 that opens and closes the first intake duct 410 may include a first main body 7111 formed in a left-to-right side longer than a front-to-rear side with respect to a front surface of the first cabinet and having a curved surface on the front-to-rear side, and a first sub-body 7112 with a circular shape coupled to each of both ends in left and right directions of the first main body. That is, both ends of the first main body 7111 may include the first sub-body 7112, which has a circular shape like both ends of a general cylinder, but the first main body 7111 connecting the first sub bodies 7112 at both ends does not have a cylindrical shape, but may have at least two curved surfaces with different radii of curvature, and here, a size of the first main body 7111 orthogonally projected onto a virtual plane is the same as a diameter of the first sub-body, and eventually is equal to the length of a front-to-rear section of the first intake duct 410.

Accordingly, when the first blocker 711 rotates, the first main body 7111 may close the inside of the first intake duct 410. In addition, the length of the first blocker 711 in a left and right direction is longer than that in a front and rear direction to correspond to a cross section of the inside of the first intake duct 410. As such, when the first blocker 711 rotates, the first main body 7111 may close the first intake duct 410, and when the first blocker 711 rotates, the first main body 7111 may open the first intake duct. Since the first blocker 711 has a shape similar to a circular cylinder, it is not necessarily required to rotate the first blocker 711 in different directions for opening and closing.

The first main body 7111 may have at least two curved surfaces. Accordingly, the first main body 7111 may have a concave surface and a convex surface on the other surface. In addition, a cross section of the first main body 7111 may be in the form of a crescent that becomes thicker toward the center. This reduces a polar moment of inertia and minimizes rotational force caused by the second opening/closing driver 723.

The first main body 7111 has a shape with at least two curved surfaces in order to smoothly convert a flow direction. Thus, even if the first main body 7111 is not necessarily in such a shape, the first main body 7111 may have any shape as long as the flow is smoothly converted.

Since the first main body 7111 has a laterally long shape, the first main body 7111 may be bent by fatigue or torsion over time. To prevent this, the first main body 7111 may include a first reinforcing rib 7113 on a convex side. This is because, if the first reinforcing rib 7113 is placed on a concave surface, stress concentration may occur at a concave point.

The size of the first reinforcing rib 7113 protruding from the convex surface of the first main body 7111 is equal to or smaller than the size of the first sub-body 7112, and thus when the first sub-body 7112 is orthogonally projected in a longitudinal direction of the body 7111, the first reinforcing rib 7113 may be equal to or smaller than the orthogonal projected first sub-body 7112.

In other words, the first reinforcing rib 7113 may be disposed in a virtual cylinder surface and space formed by the first sub-body 7112.

The second blocker 721 has a shape in which a circular cylinder is positioned sideways. Specifically, the second blocker 721 that opens and closes the second intake duct 412 may include a second main body 7211 formed in a left-to-right side longer than a front-to-rear side with respect to a front surface of the first cabinet and having a curved surface on the front-to-rear side, and a second sub-body 7212 with a circular shape coupled to each of both ends in left and right directions of the second main body. That is, both ends of the second main body 7211 may include the second sub-body 7212, which has a circular shape like both ends of a general cylinder, but the second main body 7211 connecting the second sub-body 7212 at both ends does not have a cylindrical shape, but may have at least two curved surfaces, and here, a size of the second main body 7211 orthogonally projected onto a virtual plane is the same as a diameter of the second sub-body, and eventually is equal to the length of a front-to-rear section of the second intake duct 412.

Accordingly, when the second blocker 721 rotates, the second main body 7211 may close the inside of the second intake duct 412. In addition, the length of the second blocker 721 in a left and right direction is longer than that in a front and rear direction to correspond to a cross section of the inside of the second intake duct 412. As such, when the second blocker 721 rotates, the second main body 7211 may close the second intake duct 412, and when the second blocker 721 rotates, the second blocker 721 may open the second intake duct. Since the second blocker 721 has a shape similar to a circular cylinder, it is not necessarily required to rotate the second blocker 721 in different directions for opening and closing.

The second main body 7211 may have at least two curved surfaces. Accordingly, the first main body 7111 may have a concave surface and a convex surface on the other surface. In addition, a cross section of the second main body 7211 may be in the form of a crescent that becomes thicker toward the center. This reduces a polar moment of inertia and minimizes rotational force caused by the second opening/closing driver 723.

The second main body 7211 has a shape with at least two curved surfaces in order to smoothly convert a flow direction. Thus, even if the second main body 7211 is not necessarily in such a shape, the second main body 7211 may have any shape as long as the flow is smoothly converted.

Since the second main body 7211 has a laterally long shape, the second main body 7211 may be bent by fatigue or torsion over time. To prevent this, the second main body 7211 may include a second reinforcing rib 7213 on a convex side. This is because, if the second reinforcing rib 7213 is placed on a concave surface, stress concentration may occur at a concave point.

The size of the second reinforcing rib 7213 protruding from the convex surface of the second main body 7211 is equal to or smaller than the size of the first sub-body 7112, and thus when the second sub-body 7212 is orthogonally projected in a longitudinal direction of the second main body 7211, the first reinforcing rib 7113 may be equal to or smaller than the orthogonal projected second sub-body 7212.

In other words, the first reinforcing rib 7113 may be positioned in a virtual cylinder surface and space formed by the first sub-body 7112.

FIG. 5(*b*) shows an example of a connection part of the first exhaust duct 490 and the second exhaust duct 492 and the third opening/closing driver 733 for opening and closing the third blocker 731.

The first exhaust duct 490 may include the fan 470 disposed through the third connection hole 458 connected to the connection duct 450, and the communication hole 493 connected to the second exhaust duct 492 at a portion at which a direction of air flow through the fan is directed upward. The first exhaust duct 490 may include the third blocker 731 for opening and closing the communication hole 493, and a third opening/closing driver for driving the same may be positioned on an outer side of the first exhaust duct 490.

A coupler may be provided around the communication hole to connect the second exhaust duct 492 to the first exhaust duct 490, and thus the second exhaust duct 492 may be fixed and connected to the first exhaust duct 490 through a coupling member.

Figure 6:
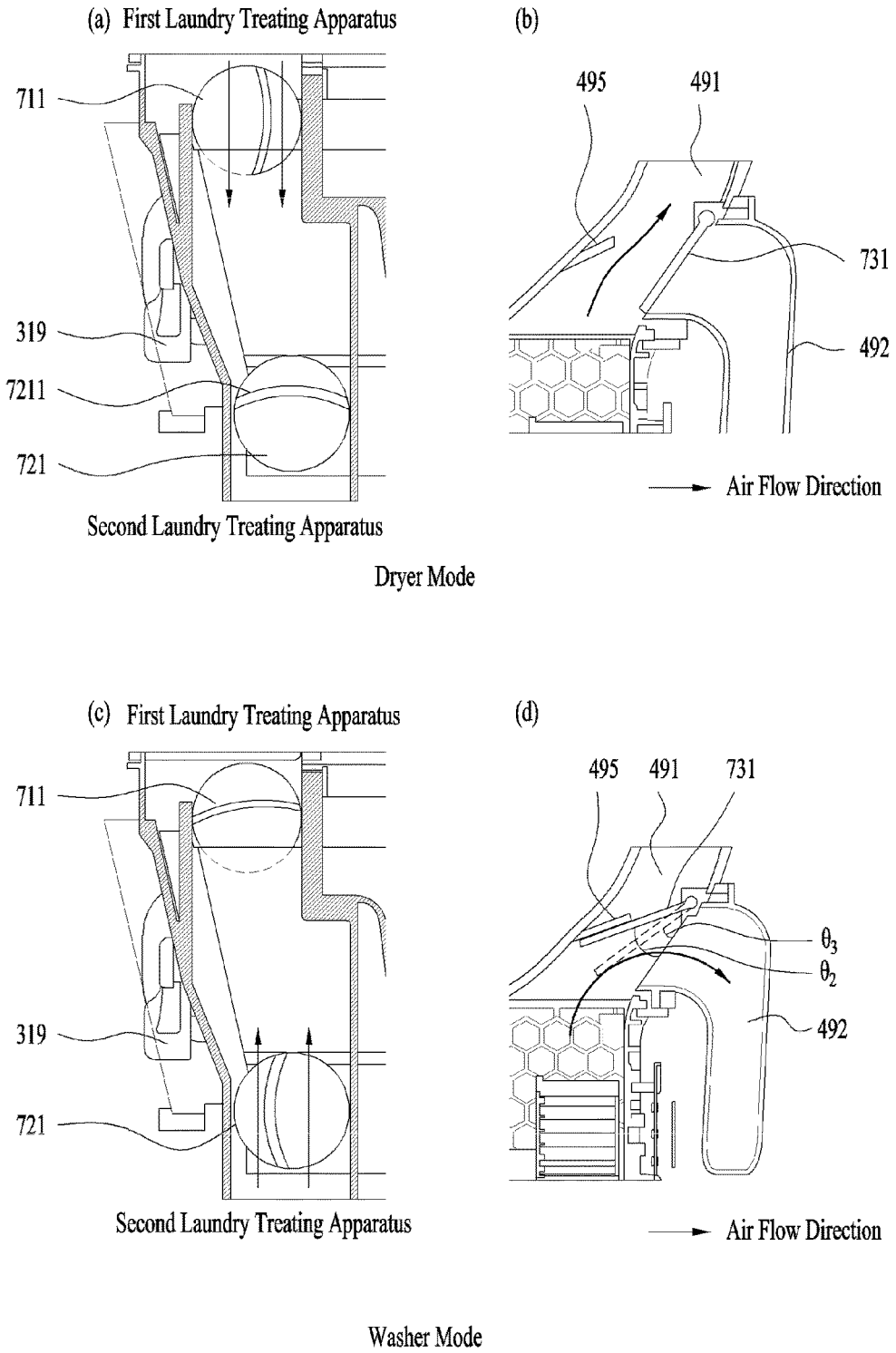
FIGS. 6(*a*) and 6(*b*) show an example in which a first intake duct is opened through a first blocker, a second intake duct is closed through a second opening/closing unit, and a second exhaust duct is closed through a third opening/closing unit when air of a first drum is circulated.

FIGS. 6(*a*) and 6(*b*) show an example in which the first intake duct 410 is opened through the first blocker 711, the second intake duct 412 is closed through the second blocker 721, and the second exhaust duct is closed through the third blocker 731 when air of the first drum 130 is circulated. FIGS. 6(*c*) and 6(*d*) show an example in which the first intake duct 410 is closed through the first opening/closing unit 710, the second intake duct 412 is opened through the second opening/closing unit 720, and the first exhaust duct 490 is closed through the third blocker 731 when air of the tub 220 is circulated.

FIG. 6(*a*) shows the case in which the first blocker 711 is opened, the second blocker 721 is closed, and the first intake duct 410 is opened. The first blocker 711 may be connected to a rotation shaft of the first opening/closing driver 713 in a longitudinal direction of the first main body 7111, and along rotation of the first opening/closing driver 713, the first main body 7111 may rotate. When the first blocker 711 rotates at a predetermined angle, the first intake duct 410 may be opened. Similarly, as shown in FIG. 6(*c*), the second blocker 721 may be connected to a rotation shaft of the second opening/closing driver 723 in a longitudinal direction of the second main body 7211, and along rotation of the second opening/closing driver 723, the second main body 7211 may rotate. When the second blocker 721 rotates at a predetermined angle, the second intake duct 412 may be opened.

Since a controller (not shown) independently controls the first blocker 711 and the second blocker 721, only the first blocker 711 may be opened, and the second blocker 721 may be closed, and in contrast, the blocking part 711 may be closed, and only the second blocker 721 may be opened. Drying functions of the first laundry treating apparatus 1000 and the second laundry treating apparatus 2000 may also be simultaneously used by simultaneously opening the first blocker 711 and the second blocker 721.

FIG. 6(*b*) shows an example in which the third blocker 731 closes the communication hole 493 to close the second exhaust duct 492. In the present specification, when the third blocker 731 closes the second exhaust duct 492, the third blocker 731 may be referred to as being in the first position. When the third blocker 731 is in the first position, a circulation path of the first laundry treating apparatus may be formed through the first exhaust duct 490.

In contrast, FIG. 6(*d*) shows an example in which the third blocker 731 opens the communication hole 493 to open the second exhaust duct 492. When the third blocker 731 is rotated inside the first exhaust duct 490 and reaches a position (second position) for closing the first exhaust duct, a guide 495 for preventing the third blocker 731 from rotating any more may be provided. The guide 495 may prevent excessive rotation of the third blocker 731 to prevent the third blocker 731 from being deformed or damaged.

To reach the second position, the third blocker 731 needs to rotate at a predetermined angle through the third opening/closing driver. When a rotation angle at the first position is a first rotation angle, for example, 0 degrees (°), and an angle at the second position is a second rotation angle $\theta_2$, the third blocker 731 may be rotated at a predetermined angle $\theta_3$ between the first rotation angle and the second rotation angle and may be positioned at the third position.

When the third blocker 731 is positioned at the third position, both the first exhaust duct 490 and the second exhaust duct 492 may be opened. Accordingly, as necessary, the controller may use both a drying function of the first laundry treating apparatus and a drying function of the second laundry treating apparatus.

The present disclosure may be modified and implemented in various forms, but the scope of the present disclosure is not limited to the above-described embodiments. Accordingly, if the modified embodiment includes components of the claims according to the present disclosure, it should be regarded as belonging to the scope of the present disclosure.

The invention claimed is:

1. A laundry treating apparatus comprising:

a first cabinet that defines at least a portion of an outer appearance of the laundry treating apparatus;

a first drum rotatably disposed inside the first cabinet and configured to accommodate laundry;

a second cabinet disposed below the first cabinet;

a tub disposed inside the second cabinet;

a second drum rotatably disposed inside the tub and configured to accommodate laundry;

a first intake duct configured to receive air from the first drum;

a first opening/closing unit configured to open and close the first intake duct;

a second intake duct configured to receive air from the tub;

a second opening/closing unit configured to open and close the second intake duct;

a connection duct connected to the first intake duct and the second intake duct;

a heat exchanger disposed in the connection duct and configured to exchange heat with the air received in the connection duct;

a first exhaust duct configured to guide the air heat-exchanged through the heat exchanger to the first drum;

a second exhaust duct configured to guide the air heat-exchanged through the heat exchanger to the tub; and a first purifier disposed in the connection duct and configured to filter a foreign substance from the air received from the first intake duct or the second intake duct before the heat exchanger exchanges heat with the air received from the first intake duct or the second intake duct, wherein the first opening/closing unit comprises:

a first blocker configured to open and close the first intake duct, and a first opening/closing driver connected to the first blocker and configured to rotate the first blocker to thereby open and close the first intake duct by the first blocker, and wherein the first blocker comprises:

a first main body that extends in a left-right direction and defines first curved surfaces that are curved in a front-rear direction, wherein a length of the first main body in the left-right direction is greater than a width of the first main body in the front-rear direction, and first sub-bodies that have a circular shape and are coupled to left and right ends of the first main body, respectively.

2. The laundry treating apparatus of claim 1, wherein the first cabinet and the second cabinet are parts of a single cabinet.

3. The laundry treating apparatus of claim 1, further comprising:

a third opening/closing unit configured to branch the air heat-exchanged through the heat exchanger to the first exhaust duct or the second exhaust duct, wherein the first opening/closing unit, the second opening/closing unit, and the third opening/closing unit are configured to independently operate to define (i) a first circulation path configured to guide the air from the first drum through the first intake duct, the connection duct, and the first exhaust duct, or (ii) a second circulation path configured to guide the air from the tub through the second intake duct, the connection duct, and the second exhaust duct.

4. The laundry treating apparatus of claim 3, wherein the first opening/closing unit is disposed between the first intake duct and the connection duct, and wherein the second opening/closing unit is disposed between the second intake duct and the connection duct.

5. The laundry treating apparatus of claim 4, wherein the first cabinet or the second cabinet defines a filter insertion hole that allows the first purifier to be detached from the connection duct, the filter insertion hole being defined at a bottom of the first cabinet or a top front surface of the second cabinet.

6. The laundry treating apparatus of claim 5, wherein the first opening/closing unit is disposed between the first intake duct and an upper part of the first purifier, and wherein the second opening/closing unit is disposed between the second intake duct and the first purifier.

7. The laundry treating apparatus of claim 3, wherein the second opening/closing unit comprises:

a second blocker configured to open and close the second intake duct; and a second opening/closing driver configured to rotate the second blocker to thereby open and close the second intake duct by the second blocker.

8. The laundry treating apparatus of claim 7, wherein the second blocker comprises:

a second main body that extends in the left-right direction and defines second curved surfaces that are curved in the front-rear direction, wherein a length of the second main body in the left-right direction is greater than a width of the second main body in the front-rear direction; and second sub-bodies that have a circular shape and are coupled to left and right ends of the second main body, and wherein a thickness of a cross-section of the second main body increases toward a center of the second main body.

9. The laundry treating apparatus of claim 8, wherein the second opening/closing driver comprises a rotation shaft that extends in the left-right direction and is connected to one of the second sub-bodies.

10. The laundry treating apparatus of claim 8, wherein the second blocker further comprises a plurality of second reinforcing ribs that protrude from a convex surface among the second curved surfaces of the second main body, wherein a portion of the second sub-bodies is disposed at the convex surface of the second main body and faces the plurality of second reinforcing ribs, and wherein a size of each of the plurality of second reinforcing ribs is less than or equal to a size of the portion of the second sub-bodies disposed at the convex surface of the second main body.

11. The laundry treating apparatus of claim 7, wherein a length of the first blocker in the left-right direction is greater than a length of the second blocker in the left-right direction.

12. The laundry treating apparatus of claim 3, wherein the third opening/closing unit comprises:

a third blocker configured to open and close the first exhaust duct and the second exhaust duct; and a third opening/closing driver configured to rotate the third blocker to open and close the first exhaust duct and the second exhaust duct.

13. The laundry treating apparatus of claim 12, wherein the first exhaust duct comprises a guide disposed inside the first exhaust duct and configured to limit rotation of the third blocker, the guide being configured to contact the third blocker based on the third blocker rotating into the first exhaust duct to close the first exhaust duct.

14. The laundry treating apparatus of claim 3, wherein the third opening/closing unit comprises:

a third blocker configured to open and close the first exhaust duct and the second exhaust duct; and a third opening/closing driver configured to rotate the third blocker to (i) a first position at which the third blocker opens the first exhaust duct and closes the second exhaust duct to thereby define the first circulation path, (ii) a second position at which the third blocker opens the second exhaust duct and closes the first exhaust duct to thereby define the second circulation path, and (iii) a third position at which the third blocker opens a portion of each of the first exhaust duct and the second exhaust duct by a predetermined angle to thereby define both of the first circulation path and the second circulation path.

15. The laundry treating apparatus of claim 1, wherein the first opening/closing driver comprises a rotation shaft that extends in the left-right direction and is connected to one of the first sub-bodies.

16. The laundry treating apparatus of claim 1, wherein a thickness of a cross-section of the first main body increases toward a center of the first main body.

17. The laundry treating apparatus of claim 1, wherein the first blocker further comprises a plurality of first reinforcing ribs that protrude from a convex surface among the first curved surfaces of the first main body, wherein a portion of the first sub-bodies is disposed at the convex surface of the first main body and faces the plurality of first reinforcing ribs, and wherein a size of each of the plurality of first reinforcing ribs is less than or equal to a size of the portion of the first sub-bodies disposed at the convex surface of the first main body.

18. The laundry treating apparatus of claim 1, wherein the first exhaust duct defines a communication hole that is in fluid communication with the second exhaust duct, wherein the connection duct is connected to the first exhaust duct, and wherein the first exhaust duct is connected to the second exhaust duct through the communication hole.

19. The laundry treating apparatus of claim 18, further comprising a fan disposed in the first exhaust duct and configured to cause the air heat-exchanged through the heat exchanger to be discharged to the first exhaust duct or the second exhaust duct, and wherein the communication hole is defined at a position above the fan.

* * * * *